US009599418B2

(12) United States Patent
Steele

(10) Patent No.: US 9,599,418 B2
(45) Date of Patent: Mar. 21, 2017

(54) DETECTING A SIGNAL FROM A WIRELESS NETWORK FOR A FIREARM SAFETY LOCK

(71) Applicant: Alexander G. Steele, Portland, OR (US)

(72) Inventor: Alexander G. Steele, Portland, OR (US)

( * ) Notice: Subject to any disclaimer, the term of this patent is extended or adjusted under 35 U.S.C. 154(b) by 0 days.

(21) Appl. No.: 14/716,424

(22) Filed: May 19, 2015

(65) Prior Publication Data

US 2016/0341506 A1 Nov. 24, 2016

(51) Int. Cl.

| | |
|---|---|
| ***F41A 17/06*** | (2006.01) |
| ***G08C 17/02*** | (2006.01) |
| ***F41A 17/46*** | (2006.01) |
| *F41A 17/08* | (2006.01) |
| *F41A 17/48* | (2006.01) |

(52) U.S. Cl.

CPC ..... *F41A 17/063* (2013.01); *F41A 17/46* (2013.01); *G08C 17/02* (2013.01); *F41A 17/06* (2013.01); *F41A 17/08* (2013.01); *F41A 17/48* (2013.01)

(58) Field of Classification Search

CPC ..... F41A 17/063; F41A 17/06; F41A 17/46; F41A 17/066; F41A 17/54; F41A 33/00; F41A 19/68; F41A 17/48; F41A 17/08; E05F 15/77; E05G 1/005; E05G 1/024; E05G 1/10; G07C 9/00126; G07C 2009/00206; G07C 2009/00261; G07C 9/00182; F41G 3/02; F41G 3/04; F41G 3/14; F41G 9/00; Y10T 70/5031; G08C 17/02; A01K 15/021

See application file for complete search history.

(56) References Cited

U.S. PATENT DOCUMENTS

| | | | | |
|---|---|---|---|---|
| 2001/0038328 | A1* | 11/2001 | King | B60K 37/06 340/5.64 |
| 2006/0249010 | A1* | 11/2006 | John | F41A 19/68 89/1.11 |
| 2009/0052429 | A1* | 2/2009 | Pratt, Jr. | G01D 21/00 370/350 |
| 2014/0145819 | A1* | 5/2014 | Wall | E05G 1/024 340/5.2 |
| 2014/0290109 | A1* | 10/2014 | Stewart | F41A 17/063 42/70.01 |
| 2016/0054083 | A1* | 2/2016 | Kiyani | F41A 17/063 42/70.11 |
| 2016/0169604 | A1* | 6/2016 | Milde, Jr. | F41A 17/066 42/70.11 |

* cited by examiner

*Primary Examiner* — Dionne H Pendleton

(57) ABSTRACT

A signal from a wireless network and identify a parameter of the signal associated with the wireless network may be detected. A determination may be made whether to enable or disable a safety lock of a firearm in view of the parameter of the signal associated with the wireless network. Furthermore, a command may be transmitted to the safety lock of the firearm in view of the determination.

20 Claims, 7 Drawing Sheets

DETECTING A SIGNAL FROM A WIRELESS NETWORK FOR A FIREARM SAFETY LOCK

TECHNICAL FIELD

The present disclosure is generally related to firearm safety locks, and more particularly, to detecting a signal from a wireless network for control of a firearm safety lock.

BACKGROUND

In firearms, a safety lock or safety catch is a mechanism used to prevent the accidental discharge of a firearm, helping to ensure safer handling. Firearms (e.g., pistols, rifles, shotguns, machine-guns, etc.) are typically constructed with various designs and parts that may include one or more safety locks. Conventionally, a firing sequence includes a trigger that connects to a firing mechanism that activates a projectile (e.g., bullet) via springs, levers, pins, moldings, etc. A safety lock prevents activation of the projectile, for example, by enabling a locking mechanism in the firing sequence. Typically a locking mechanism can disconnect the trigger from the firing mechanism.

Safety locks are conventionally activated manually such that a user gives input, for example, by toggling a lever on the firearm from "on" to "off" or some other action. Manual safety locks are typically activated by a switch, slide, or lever, such that the manual safety lock prevents the firing of a firearm when manually activated by the user to the "safe" position. Some modern firearms require a user to input a fingerprint or wear a chip every time the firearm is operated to switch the safety lock from off to on.

Increasingly, unauthorized discharges of firearms happen in crowded public places through unintentional and intentional use. Police and security guards conventionally must screen every visitor with metal detectors and/or continually monitor surveillance equipment. For a firearm outside a security checkpoint and undetected through surveillance, the use of the firearm is not easily restricted. And while fingerprint scanners can authenticate a user, modern firearm safety lock authentication fails to restrict use of such firearms in public places, such as a school.

Accidental discharges of firearms also commonly occur in the hands of children. In all too common of a situation, a child may gain access to a firearm, take the firearm to a public place, such as a school, and intentionally or unintentionally discharge the firearm. The unauthorized possession of firearms is conventionally addressed by restricting access. However, once access to a firearm is gained, the use of the firearm is not easily restricted. Manual safety locks fail to stop unauthorized and accidental discharges of firearms in public places. For example, when a child brings a firearm to school, disabling the manual safety lock can be as simple as a flip of the switch.

BRIEF DESCRIPTION OF THE DRAWINGS

The present disclosure will be understood more fully from the detailed description given below and from the accompanying drawings of various implementations of the disclosure.

DETAILED DESCRIPTION

Figure 1:
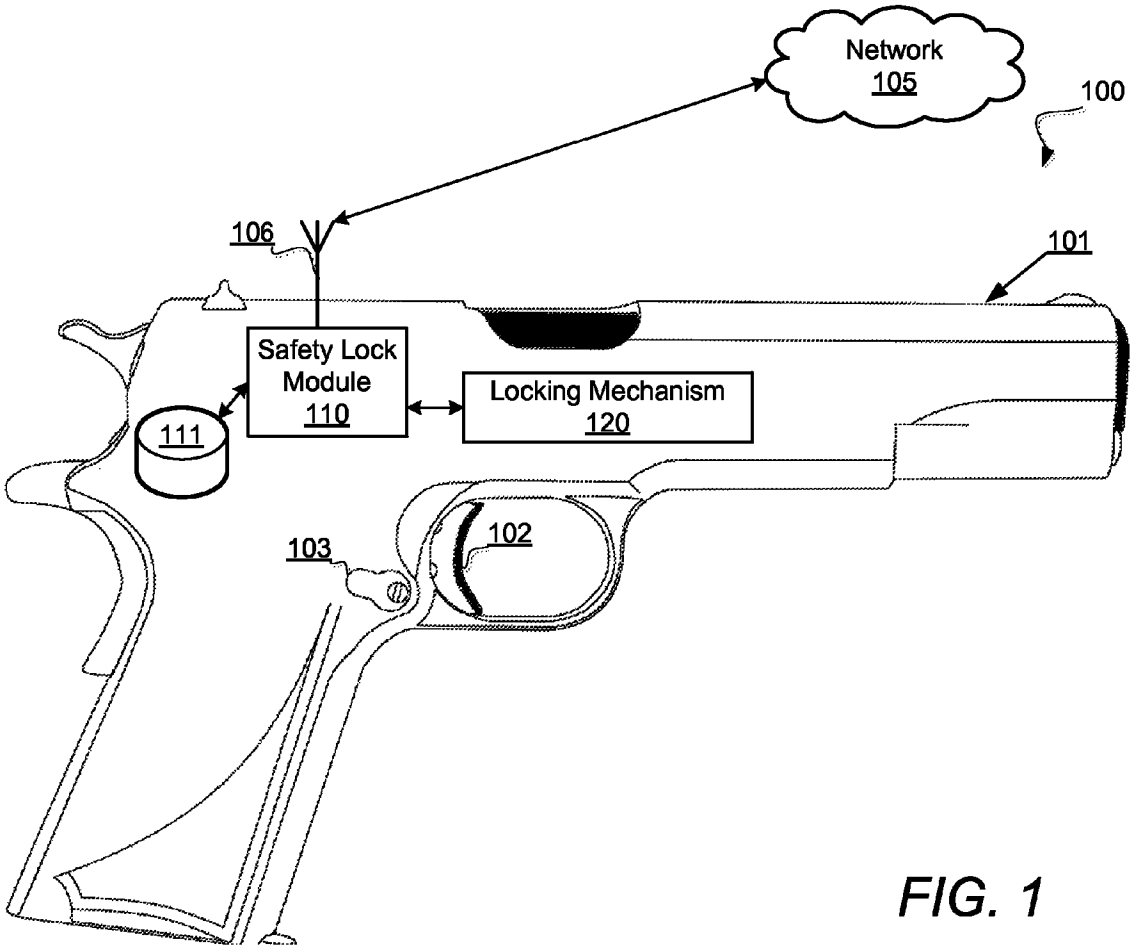
FIG. 1 illustrates an example firearm safety lock system in accordance with some embodiments of the disclosure.

Aspects of the present disclosure relate to a safety lock of a firearm that detects a signal from a wireless network. The safety lock of the firearm interrupts a firing sequence of the firearm to prevent activation of a projectile. For example, a safety lock may block the firing mechanism by blocking a hammer or a striker from forward movement or act as a block to prevent the firing mechanism from contacting a firing pin of the projectile.

A passive safety lock activates the safety lock with little to no input from a user. A passive safety lock can prevent an accidental discharge of the firearm. For example, a passive safety lock might activate in response to a firearm being dropped by blocking the firing mechanism of the firearm to prevent firing when the firearm strikes the ground.

Unauthorized discharges of firearms commonly occur in public places, such as a school. Restricting use of a firearm based on a location can provide additional tools to safeguards children. A passive safety lock that determines to activate the safety lock of the firearm in response to detecting a signal from a wireless network located in a public place can reduce accidental or unauthorized discharges. The passive safety lock can be enabled selectively and configured to the user's environment.

Embodiments of the present disclosure describe a safety lock module of a firearm that detects a signal from a wireless network (e.g., a Wi-Fi network). The safety lock module may be coupled to a locking mechanism (e.g., safety lock) that stops the firing sequence of the firearm. In an embodiment, the safety lock module identifies a parameter associated with the signal from the wireless network. For example, a Wi-Fi network broadcasts a signal that includes information about the wireless network to devices within range of a wireless network transmitter. In some embodiments, the parameter can be a name of the wireless network, such as a Wi-Fi network service set identifier (SSID). An SSID commonly includes a descriptive keyword for a location of the wireless network, such as a school, library, or "Portland Airport." In another embodiment, the parameter can be a configuration setting associated with the wireless network, such as, whether the wireless network is configured as a public network or a private network.

The safety lock module may determine to automatically enable the safety lock based on the parameter satisfying a condition. An enabled safety lock interrupts the firing sequence to prevent the firearm from firing. The condition can be a set of logic or rules employing the parameter to determine whether to enable or disable the safety lock. For example, the safety lock module can use a stored keyword list of public places to check if a network name indicates the firearm is located in a public place. In another example, the safety lock module may identify a setting associated with the wireless network from the parameter in order to determine whether to activate the safety lock. Responsive to determining that the parameter satisfies the condition, the safety lock module transmits a command to the safety lock. The command to the safety lock can be an instruction to a locking mechanism (e.g., an electric actuator, blocker, etc.) of the firearm.

Disabling the safety lock allows the firearm to be fired. In some embodiments, the safety lock module is configured to automatically disable the safety lock of the firearm in response to identifying a parameter associated with a signal of a wireless network. In an embodiment, the user enters a custom keyword list used by the safety lock module that disables the safety lock when a condition is satisfied. For example, the safety lock module can determine to disable the safety lock when in range of an owner's home wireless network (e.g., an authorized location). The safety lock module can transmit a command to the safety lock of the firearm to allow firearm to operate. The passive safety lock module allows the user to specify authorized locations that the firearm may operate without additional authentication.

Additional capabilities can be included with the safety lock module to allow users to customize and configure control of the safety lock. In some embodiments, the safety lock module can receive new keywords or logic for determining whether to enable or disable the safety lock. In an embodiment, the safety lock module can communicate with another device (e.g., smartphone, server, website, etc.) to receive data from an authorized user of the firearm. For example, configuring the safety lock module can be done via a smartphone. In some embodiments, the safety lock module receives a remote command from the user to change the safety lock from disabled to enabled, or vice versa. For example, the user can input a password on a smartphone that transmits a command to the safety lock to change states (e.g., locked or unlocked).

Thus, aspects of the present disclosure may reduce the number of accidental or unauthorized discharges of firearms in public places. The passive safety lock system detects the signal and applies logic to determine whether to activate the safety lock of the firearm based on parameters associated with the wireless networks. For example, a child that takes a parent's firearm to school will be prevented from firing the firearm when the safety lock module identifies the school Wi-Fi network name and the passive safety lock is enabled. Furthermore, schools and public places may have an additional means to enforce firearm usage restrictions. For example, the passive safety lock system of the firearm can activate to neutralize the firearm prior to passing through a metal detector and/or without a security guard visually identifying the firearm. Various aspects of the above referenced methods and systems are described in details herein below by way of example, rather than by way of limitation.

FIG. 1 illustrates an example firearm safety lock system. In various illustrative examples, a safety lock system 100 for a firearm 101 can be any type of pistol, rifle, shotgun, machine-gun, etc. The firearm safety lock system 100 can include a firearm 101 that contains a safety lock module 110 to control a locking mechanism 120. Details regarding the safety lock module 110 are described in more detail with respect to FIGS. 2-7. In general, the firearm 101 may include a trigger 102 to activate a firing sequence of the firearm. In some embodiments, the firearm may include one more additional safety locks (e.g., manual safety lock 103).

Schools and other public places commonly include wireless networks to provide Internet access to visitors. A wireless network 105 may be a local area network (LAN), metropolitan area network (MAN), or wide area network (WAN), or a combination thereof. A Wi-Fi network may broadcast an SSID from a transmitter. Typically, the SSID includes a descriptive name of the location of the wireless network.

The safety lock module 110 may detect a signal from a wireless network 105 via a receiver 106 (e.g., an antenna). The safety lock module 110 can be a computing device such as a computer, a microcontroller, a portable computing device, etc. The safety lock module 110 can include one or more processing devices, memory, and/or connect to additional internal or external input/output (I/O) device, such as a keypad, an accelerometer, a transmitter, an actuator, light emitting diodes (LED), etc.

The receiver 106 may be coupled to the safety lock module 110 for detecting the signal and can be any type of internal or external antenna 106. For example, a firearm 101 made of a conductive material can function as an internal receiver. In one embodiment, the safety lock module 110 periodically detects if there is a signal from a wireless network. In another embodiment, a sensor (not shown), such as an accelerometer, coupled to the safety lock module 110 may sense the firearm is being moved and may begin scanning frequencies to detect the signal from the wireless network 105.

In one embodiment, the safety lock module 110 can activate the locking mechanism 120 based on detecting a signal from a wireless network 105 with little to no user input, as discussed in reference to FIGS. 2-6. Determining whether to enable or disable the locking mechanism 120 can include logic and/or rules. A storage device (e.g., data store 111) can be coupled to the safety lock module 110 that can store the logic and/or rules. In another embodiment, the safety lock module 110 can communicate with a remote data store 111 via one or more networks 105 or communication modules (e.g., Bluetooth, near field communication, radio signal, etc.).

The safety lock module 110 can control a locking mechanism 120 of a firearm to prevent or allow the firearm to fire. The locking mechanism 120 interrupts a firing sequence of the firearm when enabled. For example, the locking mechanism 120 can be a blocker, latch, motor, linear actuator, etc.

Figure 2:
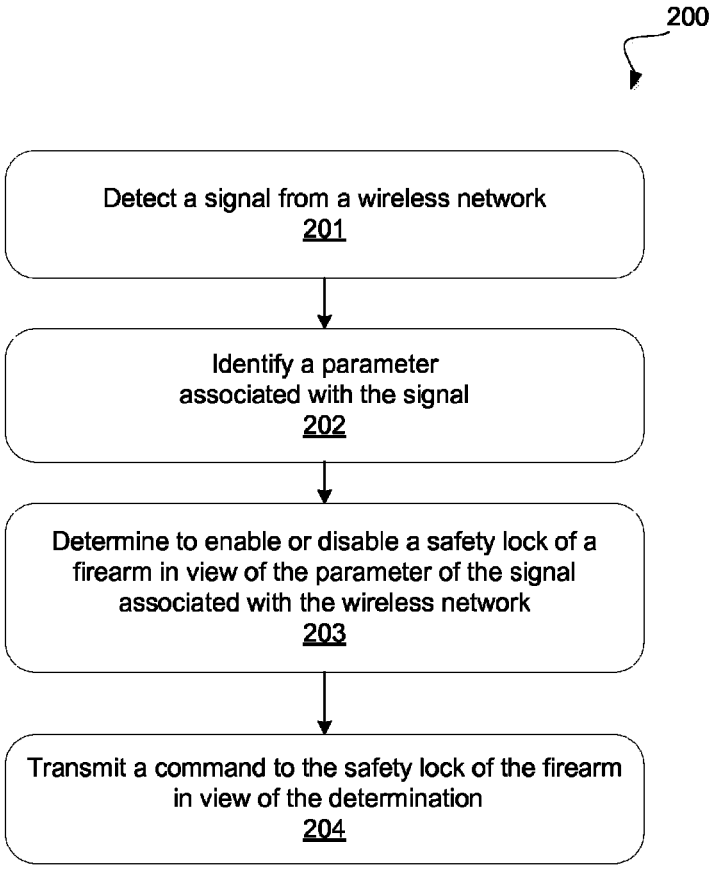
FIG. 2 is a flow diagram of an example method to determine whether to control a safety lock of a firearm based on detecting a signal from a wireless network in accordance with some embodiments of the disclosure.

FIG. 2 is a flow diagram of an example method 200 to control a safety lock of a firearm based on a parameter of a wireless. The method 200 may be performed by processing logic that can include hardware (e.g., circuitry, dedicated logic, programmable logic, microcode, etc.), software (e.g., instructions run on a processing device), or a combination thereof. In another implementation, method 200 is performed by a safety lock module (e.g., safety lock module 110 of FIG. 1).

At block 201, the processing logic may detect the signal from the wireless network. Detection of the signal may use a receiver or one or more sensors. The signal may be from a broadcasting network or non-broadcasting networks (e.g., a hidden network). For example, the safety lock module can detect a hidden signal by scanning various frequencies. At block 202, the processing logic may identify a parameter associated with the signal. As discussed, the parameter can be a network name (e.g., SSID), a configuration setting of the wireless network, location identifier, etc. Wireless networks may transmit unsecure information (e.g., network name, SSID, settings, etc.) via a signal to devices within range to initiate a login, handshake, authentication, or etc. for the device to access the wireless network. The parameter associated with the signal may be identified without accessing the wireless network. For example, a receiver (e.g., receiver 106) coupled to the safety lock module can detect a signal from the wireless network and identify the SSID or some other data embedded in the received signal without the safety lock module transmitting or sending data to the wireless network. In another example, the safety lock module does transmit a request to receive information without successfully completing an authentication process. For example, the safety lock module may ping a network transmitter. The safety lock module uses the parameter to discern a characteristic of the location of the wireless network as discussed in reference to FIGS. 4-6.

At block 203, the processing logic may determine to enable or disable the safety lock (e.g., locking mechanism 120 of FIG. 1) of the firearm in view of the parameter associated with the signal from the wireless network. Logic and/or rules that may be used to determine whether to enable the safety lock of the firearm. For example, logic may identify the SSID from the signal, determine the firearm is located in a public place based on the SSID, and decide to enable the safety lock. Once the determination is made, at block 204, the processing logic may transmit a command to the safety lock of the firearm. For example, the command can activate an electronic safety lock (e.g., actuator) of the firearm that blocks a firing sequence of the firearm.

Figure 3:
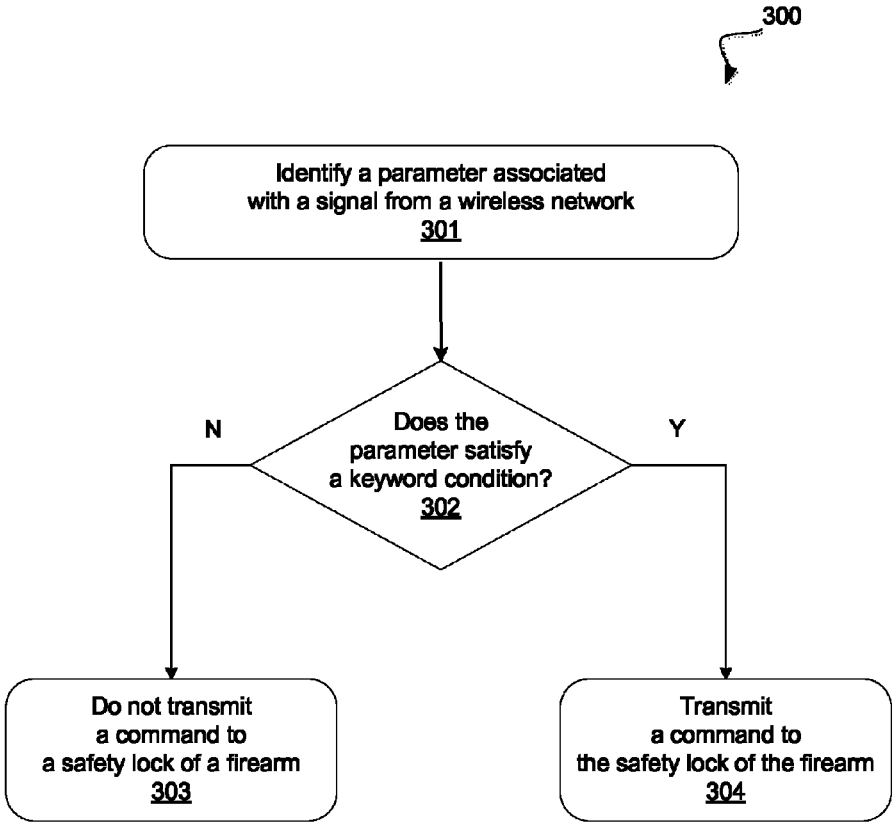
FIG. 3 is a flow diagram of an example method to determine whether to control a safety lock of a firearm based on a parameter of a wireless network in accordance with some embodiments of the disclosure.

FIG. 3 is a flow diagram of an example method 300 to determine whether to control a safety lock of a firearm based on a parameter of a wireless network. Method 300 can be performed by processing logic that can include hardware (e.g., circuitry, dedicated logic, programmable logic, microcode, etc.), software (e.g., instructions run on a processing device), or a combination thereof. In another implementation, method 300 is performed by a safety lock module (e.g., safety lock module 110 of FIG. 1).

At block 301, the processing logic identifies a parameter associated with a signal from a wireless network. As discussed, the processing logic can identify information associated with a signal from a wireless network that uses standard communication protocols. For example, the parameter can be a SSID for wireless network located at a school. At block 302, the processing logic checks if the parameter satisfies a keyword condition. The keyword condition can be logic stored in memory coupled to the processing logic. The processing logic uses the keyword condition to analyze the parameter, as discussed in reference to FIGS. 4-6. In one embodiment, the keyword condition is a keyword list and the processing logic checks if the SSID matches a keyword from the keyword list. For example, a SSID that contains a string 'school' as part of the network name may match an entry on the keyword list and therefore the keyword condition is satisfied.

In response to a keyword condition being satisfied, the processing logic may transmit a command to the safety lock of the firearm at block 304. In some embodiments, the command may either enable the safety lock or disable the safety lock. The safety lock (e.g., locking mechanism 120 of FIG. 1) prevents firing of the firearm in response to a command to enable. In one embodiment, the command can instruct the safety lock to enter a default state, such as locked.

If the parameter does not satisfy the keyword condition at block 302, the processing logic may not transmit a command to the safety lock of the firearm at block 303. For example, if the identified SSID does not match any keywords of the keyword list, then the processing logic does not change the position or state of the safety lock. If additional signals are detected, the processing logic can identify another parameter associated with one of the additional signals and continue to determine to enable or disable the safety lock in view of the new parameter. In one embodiment, the processing logic enters a passive mode and periodically scans frequencies to detect a new signal from a wireless network.

Figure 4:
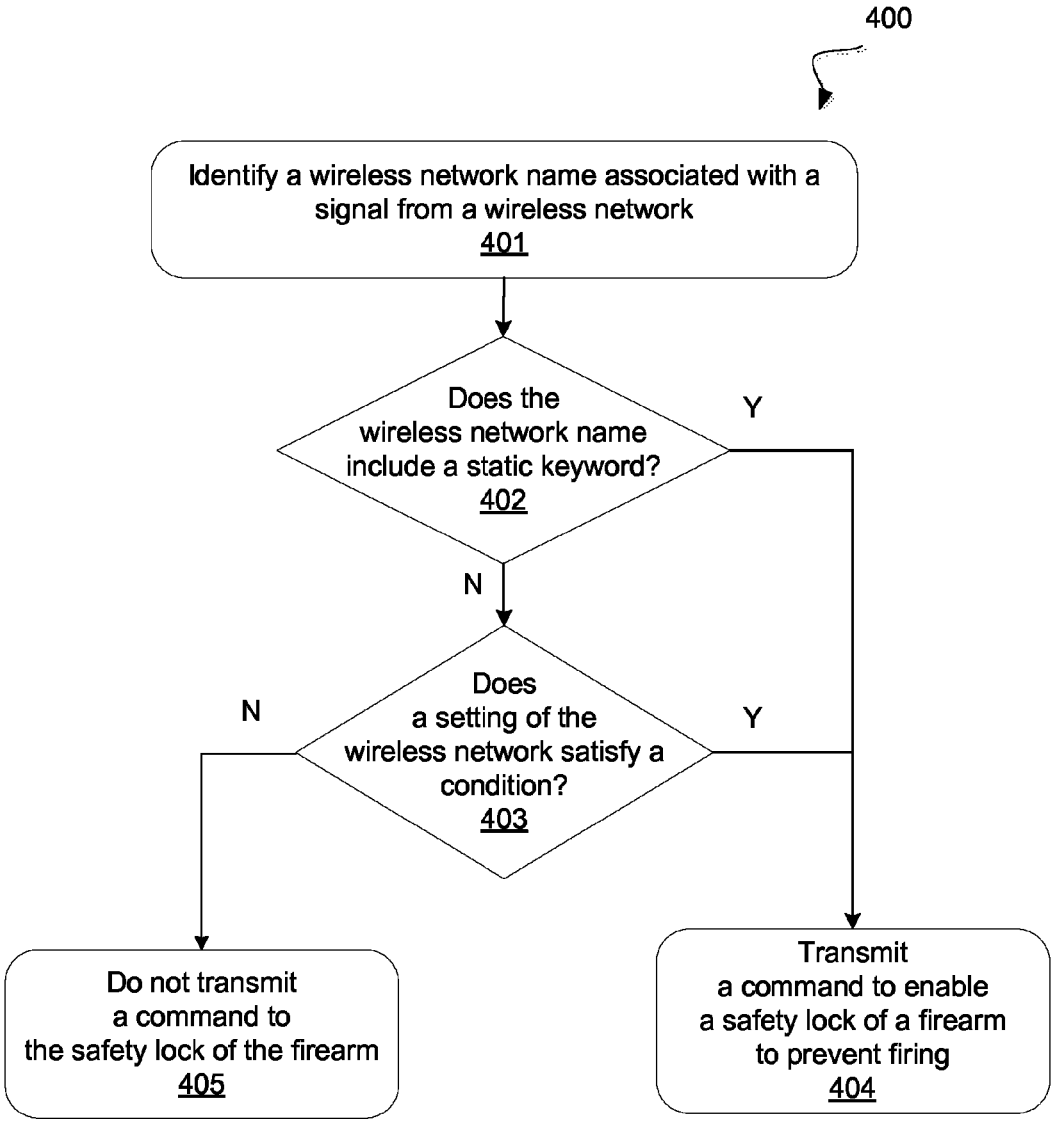
FIG. 4 is a flow diagram of an example method to enable a safety lock of a firearm based on a name and a setting of a wireless network in accordance with some embodiments of the disclosure.

FIG. 4 is a flow diagram of an example method 400 to enable a safety lock of a firearm based on a name and a setting of a wireless. In general, the method 400 may be performed by processing logic that may comprise hardware (e.g., processing device, circuitry, dedicated logic, programmable logic, microcode, etc.), software (e.g., instructions run or executed on a processing device), or a combination thereof. In some embodiments, the method 400 may be performed by a safety lock module 110 of a firearm 101 or as part of method 200 or method 300 as described with relation to FIGS. 1-3.

As shown, the method 400 may begin by the processing logic identifying a wireless network name associated with a signal from a wireless network (block 401). In an embodiment, the parameter is a wireless network name (e.g., SSID) that includes an abbreviation, keyword, or acronym that indicates a type of location for the wireless network. For example, a network administrator can configure the SSID to include a keyword, such as airport, school, mall, park, theater, etc. Then the processing logic can analyze the SSID to check if one or more conditions (e.g., keyword conditions) are satisfied. In some embodiments, the one or more conditions include one more static conditions or custom conditions, as discussed in reference to FIGS. 5-6. A static condition can be pre-programmed in read-only memory of the safety lock module.

At block 402, the processing logic of the safety lock module determines if the name of the wireless network includes a static keyword. In one embodiment, the static condition is a list of static keywords for public places (e.g., school, schl, elementary, edu, etc.). A static condition preprogrammed in read-only memory can be an established library of terms for network administrators to adopt when configuring a parameter associated with a wireless network (e.g., SSID). The processing logic can store the processing logic containing the static condition in such a way that hinders tampering by an unauthorized user. At block 402, the processing logic checks if the wireless network name contains a static keyword from the keyword list. For example, an SSID named "Central High School Wi-Fi" contains the keyword 'school' and satisfies the static condition. In response to the network name including the static keyword, the processing logic of the safety lock module can transmit a command to enable the safety lock of the firearm to prevent firing of the firearm at block 404.

The processing logic can also identify multiple parameters associated with a signal to check against one or more conditions and/or rules. If the wireless network name does not include the static keyword, the processing logic can proceed to check one or more conditions and/or rules. For example, the processing logic determines if a setting of the wireless network satisfies an additional condition at block 403. In some embodiments, the setting of the wireless network can indicate the wireless network is located in a public place. For example, the wireless network may broadcast a setting that directs devices to authenticate via a website (e.g., a pay wall, terms of service, etc.). In one embodiment, the processing logic determines to enable the safety lock of the firearm to prevent firing in response to a configuration setting indicating a public wireless network. In some embodiments, a public wireless network may refer to a wireless network that may be accessed without the providing of a username and/or password while a private wireless network may refer to a wireless network that may not be accessed until a valid username and/or password has been provided. Thus, if a public wireless network is detected, then the safety lock of the firearm may be enabled and if a private wireless network is detected, then the safety lock of the firearm may be disabled.

In another example, the processing logic can detect multiple signals from multiple wireless networks and the processing logic can determine the number of signals indicates that the firearm is located in a densely populated area. For example, the safety lock of the firearm may be enabled or disabled based on a threshold number of wireless networks that are detected. If a number of wireless networks that exceed the threshold number are detected, then the safety lock of the firearm may be enabled. If the number of wireless networks is equal to or does not exceed the threshold number, then the safety lock of the firearm may be disabled.

In some embodiments, the setting of the wireless network can be an identified parameter from the signal or received in response to request transmitted to the wireless network. For example, a parameter containing an Internet protocol (IP) address of the wireless network might identify the wireless network is at a commercial location. At block 404, the processing logic transmits the command to enable the safety lock of the firearm to prevent firing of the firearm in response to determining one or more of the conditions are satisfied. At block 405, the processing logic does not transmit a command to the safety lock of the firearm of the firearm in response to determining that a condition is not satisfied.

Figure 5:
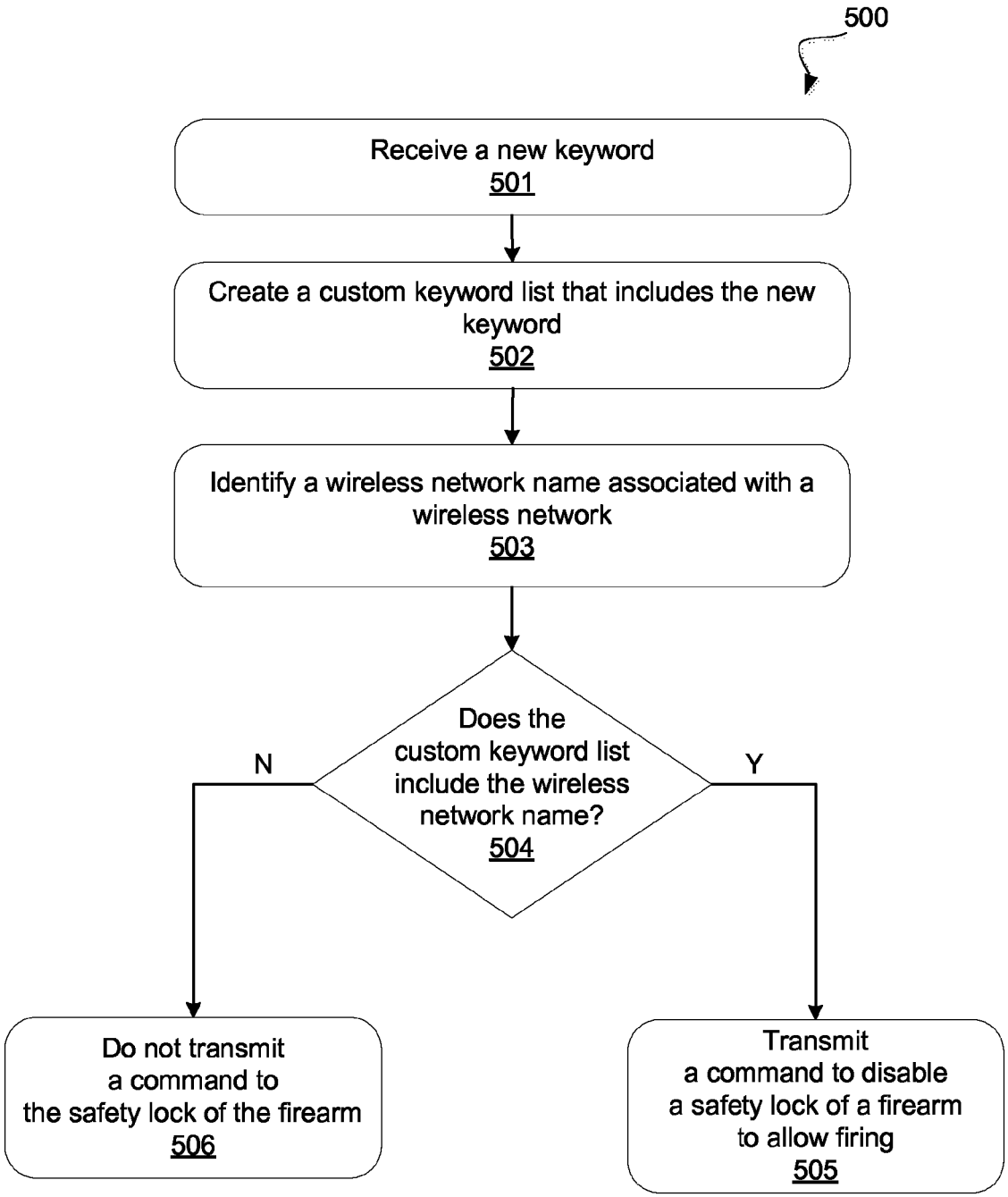
FIG. 5 is a flow diagram of an example method to create a custom keyword list and to disable a safety lock of a firearm based on the custom keyword list in accordance with some embodiments of the disclosure.

FIG. 5 is a flow diagram of an example method 500 to create a custom keyword list and to disable a safety lock of a firearm based on the custom keyword list. In general, the method 500 may be performed by processing logic that may comprise hardware (e.g., processing device, circuitry, dedicated logic, programmable logic, microcode, etc.), software (e.g., instructions run or executed on a processing device), or a combination thereof. In some embodiments, the method 500 may be performed by a safety lock module 110 of a firearm 101 or as part of methods 200, 300, or 400 as described with relation to FIGS. 1-4.

At block 501, the processing logic receives a new keyword. An authorized user can configure the processing logic with one or more custom keywords. For example, to program a new keyword, the user can employ another device (e.g., smartphone, computer, etc.) for inputting the new keyword and then transmit the new keyword to the processing logic. In some embodiments, a network detection apparatus (e.g., receiver 106 of FIG. 1) of the safety lock module that detects the signal from a wireless network may also be used for two-way communication to configure the processing logic. For example, the user can send new keywords to the processing logic through a web interface or access the processing logic via an IP address. In some embodiments, the firearm includes one more communication modules (e.g., Bluetooth, near field communication, radio signal, etc.) coupled to the safety lock module for configuring the processing logic of the safety lock module. In another embodiment, the safety lock module may provide an input interface (e.g., a micro universal serial bus) to connect to the other device. The processing logic receives the new keyword and stores the new keyword in memory coupled to the processing logic (e.g., data store 111 of FIG. 1). At block 502, the processing logic can create one or more custom keyword lists that include the new keyword.

The keyword can be any programmable condition specified by configuring the processing logic. For example, the new keyword can be a name of a home network of a user (e.g., the firearm owner). The processing logic can detect the signal from the wireless network. At block 503, the processing logic identifies a wireless network name associated with the wireless network. At block 504, the processing logic determines if the custom keyword list includes the wireless network name. At block 505, the processing logic transmits a command to disable the safety lock of the firearm. For example, the processing logic can transmit a command to disable the safety lock in response to determining the firearm is located at the firearm owner's home in view of the detected wireless network name matching the programmed custom keyword. Otherwise, at block 506, the process can end and the processing logic does not transmit a command. Disabling the safety lock may allow the firearm to be fired. In some embodiments, the firearm may include one or more additional safety locks (e.g., manual safety lock 103 of FIG. 1) and the additional safety locks must also be disabled for the firearm to fire. For example, the processing logic can transmits a command to passively disable the safety lock of the firearm, the user can disable an additional manual safety lock by squeezing a pressure sensor, and the user can squeeze a trigger to fire the firearm.

In another embodiment, the keyword includes a rule, such as, a timer period, sensor reading (e.g., accelerometer detects a movement pattern), etc. For example, a home protection rule may command to disable the safety lock at 10 p.m. and enable the safety lock at 6 a.m. The firearm owner can program the firearm to automatically disable the safety lock for home defense. The processing logic can combine one or more additional keywords. In another example, the processing logic can identify the wireless network name matches the firearm owner's home network (e.g., home network name) and the time is past midnight then the processing logic transmits the command to disable the safety lock of the firearm and allow the firearm to be fired. In another example, the processing logic can automatically enable the safety lock in response to failing to detect the firearm owner's home network when an accelerometer detects the firearm is moved or picked up.

Figure 6:
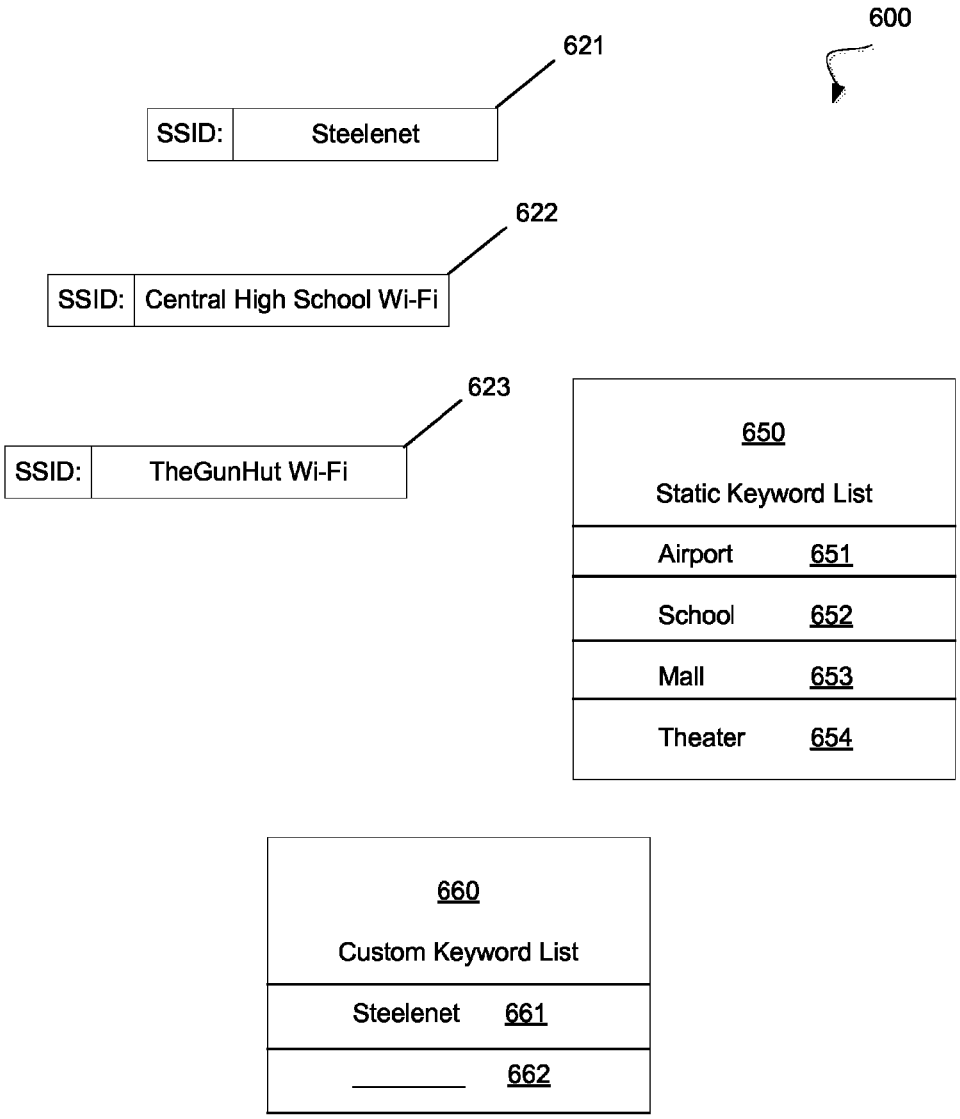
FIG. 6 is an illustrated example of a keyword system for controlling a safety lock of a firearm in accordance with some embodiments of the disclosure.

FIG. 6 is an illustrated example of a keyword system 600 for controlling a safety lock of a firearm. In general, the keyword system 600 can be stored in a data store (e.g., data store 111 of FIG. 1) coupled to a safety lock module (e.g., safety lock module 110 of FIG. 1) and used in accordance with processing logic as described in FIGS. 2-5. The keyword system 600 can include one or more keyword lists 650, 660 that are processed by the processing logic of the safety lock module in view of one or more parameters 621, 622, or 623 associated with a signal from a wireless network. The processing logic can use the keyword lists 650, 660 for determining whether to enable or disable the safety lock of the firearm.

In an embodiment, a static keyword list 650 can be stored on read-only memory and contain a list of keywords that enable the safety lock of the firearm. For example, the processing logic may be pre-programmed with common keywords of public places, such as airport 651, school 652, mall 653, theater 654, etc. A network administrator of the wireless network in a public place may employ a term from one of the static keywords as part of a naming convention for the wireless network. For example, a high school administrator can configure a SSID of the Wi-Fi at the high school to include the keyword 'high school.' In this example, the processing logic can identify the keyword as part of the SSID to indicate that the wireless network is located in a public place and then transmit a command to lock the firearm. In one embodiment, the static keyword list is stored in such a way that it cannot be edited, overwritten, or deleted in order to prevent tampering.

Additional custom keyword list 660 can be added to the processing logic for determining whether to enable or disable the passive safety lock of the firearm in view of a parameter associated with a signal from a wireless network. In an embodiment, a custom keyword list 660 can be programmed to disable the safety lock in view of the parameter associated with the detected signal from the wireless network. For example, a firearm owner can program the custom keyword list 660 to include a new keyword that matches part of a wireless network located at the owner's home (e.g., Steelenet 661). In this example, when the processing logic identifies an SSID associated with the owner's wireless network, the processing logic determines to disable the safety lock and transmit a command to the safety lock to prevent the firearm from firing.

The processing logic may determine not to transmit a command to the safety lock in response to detecting the parameter that does not satisfy the condition (e.g., match the keyword). For example, the processing logic may not transmit a command in response to an SSID TheGunHut Wi-Fi 623 that does not contain any of the static keywords 651-654 and does not match the custom keywords 661-662.

In one embodiment, an override command can change a state of the safety lock. For example, the authorized user can input a passcode using another device (e.g., smartphone) to override the safety lock. In this example, the processing logic receives the override command, determines the override command contains an authentication code (e.g., pin, passcode, etc.), and transmits the control command to enable or disable the safety lock.

Figure 7:
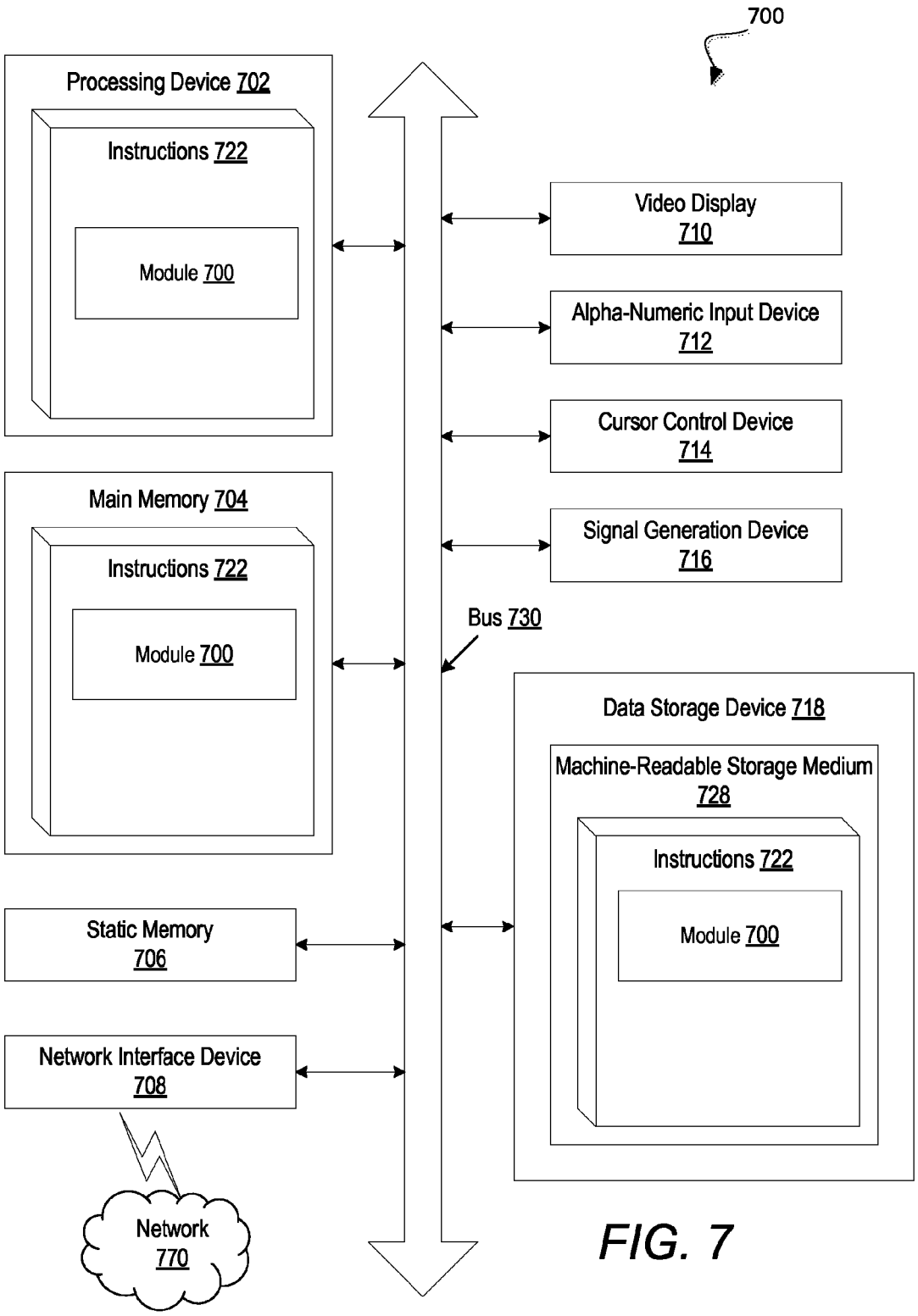
FIG. 7 illustrates a block diagram of an embodiment of a computer system in which some embodiments of the disclosure may operate.

FIG. 7 illustrates a block diagram of an embodiment of a computer system. An example machine of a computer system 700 within which a set of instructions, for causing the machine to perform any one or more of the methodologies discussed herein may be executed. In alternative implementations, the machine may be connected (e.g., networked) to other machines in a LAN, an intranet, an extranet, and/or the Internet. The machine may operate in the capacity of a server or a client machine in client-server network environment, as a peer machine in a peer-to-peer (or distributed) network environment, or as a server or a client machine in a cloud computing infrastructure or environment.

The machine may be a personal computer (PC), a tablet PC, a set-top box (STB), a Personal Digital Assistant (PDA), a cellular telephone, a web appliance, a server, a network router, a switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The example computer system 700 includes a processing device 702, a main memory 704 (e.g., read-only memory (ROM), flash memory, dynamic random access memory (DRAM) such as synchronous DRAM (SDRAM) or DRAM (RDRAM), etc.), a static memory 707 (e.g., flash memory, static random access memory (SRAM), etc.), and a data storage device 718, which communicate with each other via a bus 730.

Processing device 702 represents one or more general-purpose processing devices such as a microprocessor, a central processing unit, or the like. More particularly, the processing device may be complex instruction set computing (CISC) microprocessor, reduced instruction set computing (RISC) microprocessor, very long instruction word (VLIW) microprocessor, or processor implementing other instruction sets, or processors implementing a combination of instruction sets. Processing device 702 may also be one or more special-purpose processing devices such as an application specific integrated circuit (ASIC), a field programmable gate array (FPGA), a digital signal processor (DSP), network processor, or the like. The processing device 702 is configured to execute instructions 722 for performing the operations and steps discussed herein.

The computer system 700 may further include a network interface device 708. The computer system 700 also may include a video display unit 710 (e.g., a liquid crystal display (LCD) or a cathode ray tube (CRT)), an alphanumeric input device 712 (e.g., a keyboard), a cursor control device 714 (e.g., a mouse), and a signal generation device 717 (e.g., a speaker).

The data storage device 718 may include a machine-readable storage medium 728 (also known as a non-transitory computer-readable storage medium) on which is stored one or more sets of instructions or software 722 embodying any one or more of the methodologies or functions described herein. The instructions 722 may also reside, completely or at least partially, within the main memory 704 and/or within the processing device 702 during execution thereof by the computer system 700, the main memory 704 and the processing device 702 also constituting machine-readable storage media.

In one implementation, the instructions 722 include instructions for a safety lock module (e.g., safety lock module 110 of FIG. 1) and/or a software library containing methods that call modules or sub-modules in the safety lock module. While the machine-readable storage medium 728 is shown in an example implementation to be a single medium, the term "machine-readable storage medium" should be taken to include a single medium or multiple media (e.g., a centralized or distributed database, and/or associated caches and servers) that store the one or more sets of instructions. The term "machine-readable storage medium" shall also be taken to include any medium that is capable of storing or encoding a set of instructions for execution by the machine and that cause the machine to perform any one or more of the methodologies of the present disclosure. The term "machine-readable storage medium" shall accordingly be taken to include, but not be limited to, solid-state memories, optical media and magnetic media.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "detecting" or "identifying" or "determining" or "transmitting" or "receiving" or "generating" or "creating" or "sending" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage devices.

The present disclosure also relates to an apparatus for performing the operations herein. This apparatus may be specially constructed for the intended purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The algorithms and displays presented herein are not inherently related to any particular computer or other apparatus. Various general purpose systems may be used with programs in accordance with the teachings herein, or it may prove convenient to construct a more specialized apparatus to perform the method. The structure for a variety of these systems will appear as set forth in the description below. In addition, the present disclosure is not described with reference to any particular programming language. It will be appreciated that a variety of programming languages may be used to implement the teachings of the disclosure as described herein.

The present disclosure may be provided as a computer program product, or software, that may include a machine-readable medium having stored thereon instructions, which may be used to program a computer system (or other electronic devices) to perform a process according to the present disclosure. A machine-readable medium includes any mechanism for storing information in a form readable by a machine (e.g., a computer). For example, a machine-readable (e.g., computer-readable) medium includes a machine (e.g., a computer) readable storage medium such as a read only memory ("ROM"), random access memory ("RAM"), magnetic disk storage media, optical storage media, flash memory devices, etc.

In the foregoing specification, implementations of the disclosure have been described with reference to specific example implementations thereof. It will be evident that various modifications may be made thereto without departing from the broader spirit and scope of implementations of the disclosure as set forth in the following claims. The specification and drawings are, accordingly, to be regarded in an illustrative sense rather than a restrictive sense.

What is claimed is:

1. A method comprising:

detecting a signal from a wireless network;

identifying a parameter of the signal associated with the wireless network;

determining, by a processing device, to enable or disable a safety lock of a firearm in view of the parameter of the signal associated with the wireless network, the parameter of the signal corresponding to a name of the wireless network that provides the signal; and transmitting a command to the safety lock of the firearm in view of the determination.

2. The method of claim 1, wherein determining to enable or disable the safety lock comprises:

determining to enable the safety lock of the firearm in response to a condition being satisfied in view of the parameter; and generating the command to lock the safety lock of the firearm.

3. The method of claim 2, wherein the condition is satisfied in response to the name matching a keyword.

4. The method of claim 1, wherein determining to enable or disable the safety lock comprises:

determining to disable the safety lock of the firearm in response to a condition not being satisfied in view of the parameter.

5. The method of claim 1, wherein the parameter is further based on a configuration setting of the wireless network and wherein to determine to enable or disable the safety lock comprises:

enabling the safety lock of the firearm to prevent firing in response to the configuration setting being a public network.

6. The method of claim 1, further comprising:

receiving an override command from a device to disable the safety lock of the firearm; and transmitting the override command to the safety lock of the firearm to allow the firearm to fire.

7. The method of claim 1, further comprising:

receiving a home network name; and creating a custom keyword list comprising the home network name, wherein the safety lock is disabled in response to the parameter matching the home network name of the custom keyword list.

8. A system comprising:

a memory;

a processing device operatively coupled to the memory, the processing device to:

detect a signal from a wireless network;

identify a parameter of the signal associated with the wireless network, the parameter of the signal corresponding to a name of the wireless network that provides the signal;

determine to enable or disable a safety lock of a firearm in view of the parameter of the signal associated with the wireless network; and transmit a command to the safety lock of the firearm in view of the determination.

9. The system of claim 8, wherein to determine to enable or disable the safety lock comprises:

determine to enable the safety lock of the firearm in response to a condition being satisfied in view of the parameter; and generate the command to lock the safety lock of the firearm.

10. The system of claim 9, wherein the condition is satisfied in response to the name matching a keyword.

11. The system of claim 8, wherein to determine to enable or disable the safety lock comprises:

determine to disable the safety lock of the firearm in response to a condition not being satisfied in view of the parameter.

12. The system of claim 8, wherein the parameter is further based on a configuration setting of the wireless network; and wherein to determine to enable or disable the safety lock comprises:

enabling the safety lock of the firearm to prevent firing in response to the configuration setting being a public network.

13. The system of claim 8, wherein the processing device is further to:

receive an override command from a device to disable the safety lock of the firearm; and transmit the override command to the safety lock of the firearm to allow the firearm to fire.

14. The system of claim 8, wherein the processing device is further to:

receive a home network name; and create a custom keyword list comprising the home network name, wherein the safety lock is disabled in response to the parameter matching the home network name of the custom keyword list.

15. A non-transitory computer readable storage medium comprising instructions, that when executed by a processing device, cause the processing device to:

detect a signal from a wireless network;

identify a parameter of the signal associated with the wireless network;

determine to enable or disable a safety lock of a firearm in view of the parameter of the signal associated with the wireless network, the parameter of the signal corresponding to a name of the wireless network that provides the signal; and transmit a command to the safety lock of the firearm in view of the determination.

16. The non-transitory computer readable storage medium of claim 15, wherein the processing device is further to:

determine to enable the safety lock of the firearm in response to a condition being satisfied in view of the parameter; and generate the command to lock the safety lock of the firearm.

17. The non-transitory computer readable storage medium of claim 16, the condition is satisfied in response to the name matching a keyword.

18. The non-transitory computer readable storage medium of claim 15, wherein to determine to enable or disable the safety lock comprises:

determine to disable the safety lock of the firearm in response to a not condition being satisfied in view of the parameter.

19. The non-transitory computer readable storage medium of claim 15, wherein the processing device is further to:

receive an override command from a device to disable the safety lock of the firearm; and transmit the override command to the safety lock of the firearm to allow the firearm to fire.

20. The non-transitory computer readable storage medium of claim 15, wherein the processing device is further to:

receive a home network name; and create a custom keyword list comprising the home network name, wherein the safety lock is disabled in response to the parameter matching the home network name of the custom keyword list.

* * * * *